United States Patent [19]

Yanagawa et al.

[11] 4,378,416

[45] Mar. 29, 1983

[54] PHOTOSENSITIVE MEMBER FOR USE IN ELECTROPHOTOGRAPHIC COPYING PROCESS

[75] Inventors: Nobuyuki Yanagawa, Chigaski; Toyozi Ishikawa; Koichi Hirokawa, both of Kawasaki, all of Japan

[73] Assignee: Ricoh Company, Ltd., Japan

[21] Appl. No.: 285,298

[22] Filed: Jul. 20, 1981

[30] Foreign Application Priority Data

Jul. 21, 1980 [JP] Japan ..... 55-99498

[51] Int. Cl.[3] ..... G03G 5/04

[52] U.S. Cl. ..... 430/56; 430/58

[58] Field of Search ..... 430/56, 58

[56] References Cited

U.S. PATENT DOCUMENTS 4,033,768 7/1977 Wieloch ..... 430/58 X

*Primary Examiner*—James R. Hoffman

*Attorney, Agent, or Firm*—Guy W. Shoup; Robert Scobey

[57] ABSTRACT

A photosensitive member used for an electrophotographic copying process includes an electrically conductive layer and a photosensitive layer formed thereon. The photosensitive layer has a surface region which is subject to an imagewise exposure to form an electrostatic latent image thereon which corresponds to an effective image area on an original which is to be copied. An area of the photosensitive layer other than the surface region which corresponds to the effective image area to be copied represents a photosensitive layer portion which substantially functions as a photosensitive member during a copying process, for example, during a charging step. The photosensitive layer portion is provided with a layer of an electrically conductive material.

11 Claims, 13 Drawing Figures

PHOTOSENSITIVE MEMBER FOR USE IN ELECTROPHOTOGRAPHIC COPYING PROCESS

BACKGROUND OF THE INVENTION

The invention relates to a photosensitive member which may be used in an electrophotographic copying process.

A photosensitive member used for an electrophotographic copying process usually comprises zinc oxide, amorphous selenium or organic photoconductor (OPC). Usually, the photosensitive member is formed as a two-layer structure having a photosensitive layer formed of a material such as described above deposited on an electrically conductive support, or alternatively a three-layer structure in which an insulating support carries an electrically conductive layer, on which a photosensitive layer is formed. However, it is essential that the photosensitive member comprises at least an electrically conductive layer and a photosensitive layer. It is usually formed as a drum or an endless belt.

Considering a copying process which utilizes a photosensitive member, there are a number of problems. By way of example, during a charging step, it is only necessary that only a surface region of the photosensitive member which corresponds to an effective image portion of the original which is to be copied be charged. However, in practice, it is too late to initiate the charging step at the time the leading edge of the region of the photosensitive layer corresponding to the effective image area moves into a charger. It is also difficult to achieve an accurate coincidence between the initiation of the charging step and the movement of such region into the charger. For these reasons, the charging step is initiated before the leading edge of the region corresponding to the effective image area moves into the charger. This results in other portions of the photosensitive member other than the region corresponding to the effective image area to be charged unintendedly, causing a subsequent toner deposition and forming a solid black area thereon. In other words, these portions effectively function as part of the photosensitive member though undesirable. This also causes an increased loading during a developing and a cleaning step, requiring an increased use of toner. To accommodate for this, there has been a proposal to eliminate the charge on these portions of the photosensitive member other than the region corresponding to the effective image area as by irradiation from a quenching lamp, for example. However, the provision of such apparatus results in a complex arrangement of the copying machine.

An endless belt essentially comprising an organic photoconductor is known and is commonly referred to as an OPC photosensitive belt, which comprises an insulating support formed of polyester film carrying a conductive aluminium layer thereon, on which an OPC photosensitive layer is formed to provide a three-layer construction. When such photosensitive member is used, it is essential that the conductive layer be connected to the electrical ground. Hence, the conductive layer is partly exposed outside the surface photosensitive layer for contact with a brush for electrical connection with the ground. A variety of techniques are proposed to provide an electrical connection with the ground. Presently, the use of a brush is considered to be most favorable in that it is inexpensive and provides a compact structure.

However, the brush technique achieves the electrical connection with the ground by disposing a metal or carbon brush in sliding contact with the exposed portion of the conductive layer of the rotating OPC photosensitive belt, so that there arises the problem of the conductive layer being abraded. The conductive layer is normally formed by evaporation of aluminium or like material, and has a reduced thickness on the order of 400 to 700 Å. Hence, as a result of sliding contact of the brush therewith over a prolonged period of time, the conductive layer becomes excessively abraded, causing a failure of the electrical connection with the ground. In certain instances, the insulating support may be exposed in the three-layer construction, causing the exposed insulating layer to be charged to cause a toner deposition thereon.

SUMMARY OF THE INVENTION

In accordance with the invention, a photosensitive member for use in an electrophotographic copying process comprises an electrically conductive layer, a photosensitive layer formed thereon, and a layer of electrically conductive material formed on an area of the photosensitive member other than a surface region corresponding to an effective image area to be copied and which is substantially capable of functioning as a photosensitive member during the copying process.

With the photosensitive member of the invention, a toner deposition on an area of the photosensitive member which has an undesirable and unintended functioning to serve as a photosensitive member is avoided since such area is formed with a conductive layer. If such area happens to be charged, there occurs no solid black portion on the copy. In this manner, a loading on a developing unit and a cleaning unit can be reduced while reducing the toner consumption. By disposing a brush in contact with the layer of the electrical conductive material which is located topmost to provide an electrical connection with the ground, the abrasion of the lower conductive layer can be prevented, thus eliminating a failure of the electrical connection with the ground or the external exposure of the surface of the insulating support as mentioned above.

Therefore, it is an object of the invention to provide a photosensitive member for use in an electrophotographic copying machine which is capable of preventing the occurrence of a solid black portion on a copy and preventing a failure of the electrical connection with the ground while simultaneously reducing a loading on a developing unit and a cleaning unit.

Above and other object of the invention will be become apparent from the following detailed description of an embodiment thereof with reference to the drawings.

DESCRIPTION OF EMBODIMENT

Figure 1:
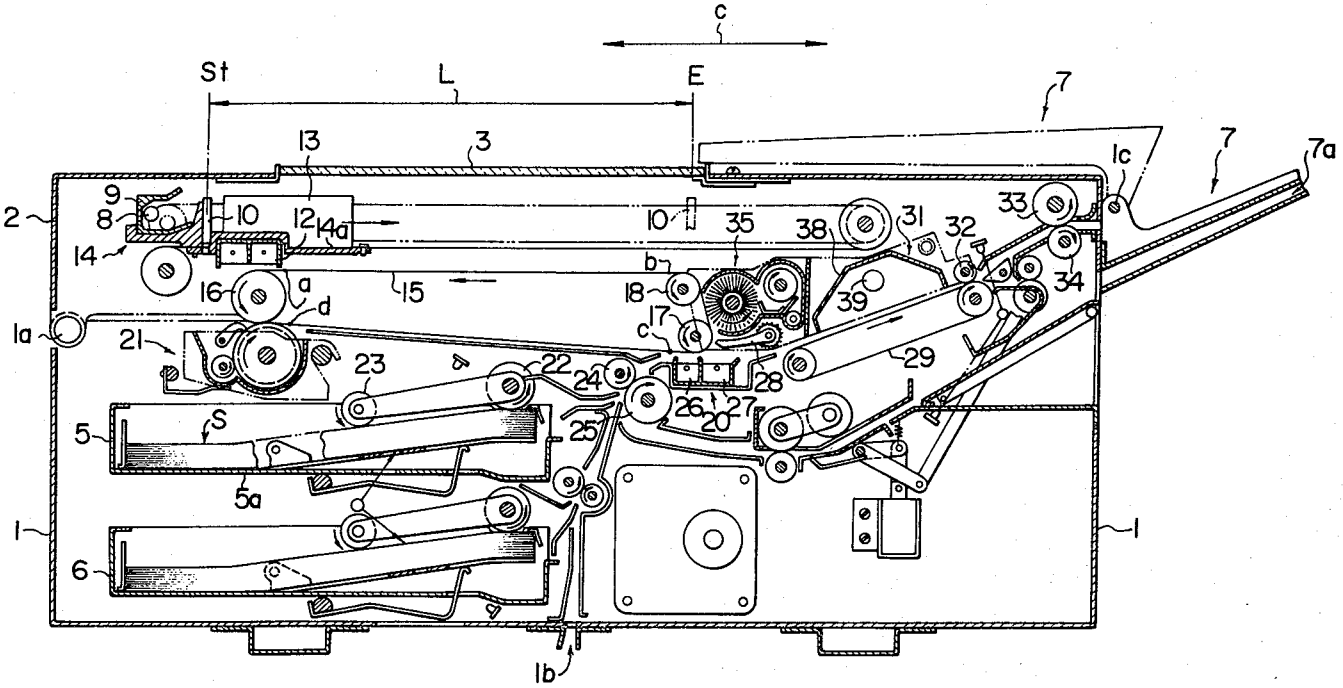
FIG. 1 is a schematic side elevation, partly in section, of an electrophotographic copying machine in which a photosensitive member according to the invention may be used.

Referring to FIG. 1, there is shown an exemplary electrophotographic copying machine in which the photosensitive member of the invention may be used. Before describing the present invention, a typical copying process will be mentioned initially with reference to FIG. 1.

Referring to FIG. 1, the machine includes an original receptacle glass 3 disposed on the top thereof on which an original, not shown, may be disposed in a given orientation. When a print button, not shown, is depressed, a scanner unit 14, comprising an exposure optics including an illumination lamp 8, a reflector 9 and an array 10 of focusing light transmitting members, a charger 12 and a high tension generator 13 associated with the charger, begins to move through its forward stroke in a direction indicated by an arrow, starting from a start position St until it reaches an end position E. During such movement, the charger 12 charges the surface of an OPC photosensitive belt 15, used as the photosensitive member and constructed in accordance with the invention, and simultaneously the combination of the lamp 18 and the array 10 effects an exposure scan of the charged surface to form an electrostatic latent image on the belt surface, in a region located between points a and b, which corresponds to the image of the original. During such process, the belt 15 remains stationary.

As the scanner unit 14 approaches the position E, the belt 15 which has been stationary begins to move angularly in a direction indicated by an arrow, and temporarily stops when the point a reaches a point c and the point b reaches a point d. Concurrently with the movement of the belt 15 in the direction of the arrow, the scanner unit 14 moves back from the position E until it reaches the position St immediately before the belt ceases to move. It should be understood that the distance between the points a, b representing a rectilinear portion of the belt is equal to the distance between the points c, d. In addition, the length of the belt run around a support roller 16 as measured between the points a, d is equal to the length of the belt run around a pair of adjacent support rollers 17, 18 as measured between the points c, b. When choosing the peripheral length $L_B$ of the belt in this manner, it will be seen that the movement of the belt in the direction of the arrow until the point a reaches the point c represents an intermittent movement of the belt through a distance of $\frac{1}{2}$ $L_B$.

For the reasons mentioned above, when the belt 15 has moved through the distance equal to $\frac{1}{2}$ $L_B$, the electrostatic latent image formed on the belt region located between the points a, b is converted into a visual image by means of a developing unit 21. Such visual image will be hereafter referred to as a first visual image. As will be seen, the first visual image remains stationary and is carried on the lower rectilinear run of the belt. When the belt 15 temporarily stops after its movement through the distance of $\frac{1}{2}$ $L_B$, the scanner unit 14 immediately initiates a second forward stroke starting from the position St, whereby a next electrostatic latent image is formed on the upper rectilinear run of the belt.

As mentioned previously, during the time this latent image is formed, the belt 15 remains stationary and the first visual image is in its standby mode. As the scanner unit 14 initiates its second forward stroke and approaches the position E, the belt 15 again begins to move through a distance corresponding to $\frac{1}{2}$ $L_B$. The second latent image is then converted into a visual image, referred to as a second visual image, by means of the developing unit 21. At the time the belt comes to a stop, the second visual image is maintained stationary on the lower rectilinear run of the belt, which again represents a standby mode.

Going back to a point in the process when the belt 25 initiates its movement for the second time, a copy sheet is fed from one of a pair of sheet feeder cassettes 5, 6, for example, from the cassette 5, into overlapping relationship with the first visual image to have the first visual image transferred thereto by a corona discharge process at a transfer charger 26. Subsequently, the second visual image enters its standby mode. It will be noted that the copy sheet is fed from the cassette 5 by a pair of cooperating main and auxiliary feed roller 22, 23 into the nip between a pair of register rollers 24, 25 to have its leading end placed into a transfer station defined between the transfer charger 26 and the belt 15. After the first visual image is transferred onto the copy sheet, it can be separated from the photosensitive belt 15 by virtue of the rigidity of the sheet itself and the action of a separation neutralizing charger 27 and an auxiliary separation claw 28. Subsequently, the sheet is carried by a conveyor belt 29 to pass through a fixing unit 31 where the visual image is fixed to be finally delivered onto a delivery tray 7 by means of roller 32 and delivery rollers 33, 34.

As the belt 15 ceases to move after it has moved through the distance $\frac{1}{2}$ $L_B$ for the second time, the second visual image enters its standby mode on the lower rectilinear run of the belt. As the belt 15 ceases to move, the scanner unit 14 immediately initiates its third forward stroke from the position St to form a third electrostatic latent image. As the unit 14 approaches the position E, the belt 15 initiates to move angularly for the third time, and during such movement, the third latent image is converted into a visual image by the developing unit 21 while simultaneously the second visual image is transferred onto a second copy sheet by the transfer charger 26. By repeating such process, a number of copies may be formed in succession from a single original. It will be understood that after the transfer step, any residual charge on the surface of the photosensitive belt 15 is removed by the neutralizing charger 17, and any residual toner on the surface is removed by a cleaning unit 35. The fixing unit 31 may essentially comprise a reflector 38 associated with a Xenon lamp 39. During an intermittent movement of the copy sheet, the Xenon lamp 39 may be repeatedly flashed to provide a flash fixing operation.

A photosensitive member of the invention which may be used in an electrophotographic copying process will now be described. In the description to follow, it is assumed that the invention is applied to an OPC photosensitive member, but it should be understood that the invention is not limited thereto, but may be equally applied to a variety of photosensitive members.

Figure 2:
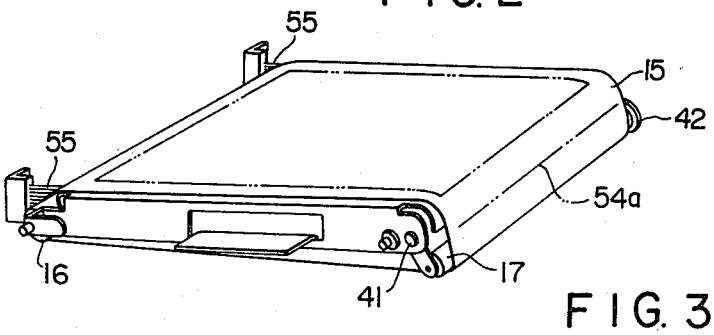
FIG. 2 is a perspective view of an OPC photosensitive belt which may be used in the copying machine shown in FIG. 1.

As shown in FIG. 1, the photosensitive belt 15 extends around support rollers 16, 17 and 18. As indicated in FIG. 2, the support roller 17 is disposed to be rockable about a fulcum shaft 41, and is urged by a spring, not shown, to maintain the belt 15 in that condition. One lateral edge of the photosensitive belt 15 is disposed to bear against a flange 42, which controls the crosswise portion of the belt.

Figure 3:
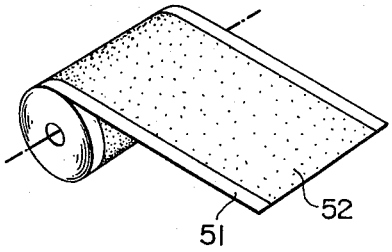
FIG. 3 is a view of a material used to manufacture the photosensitive member according to the invention.
Figure 4:
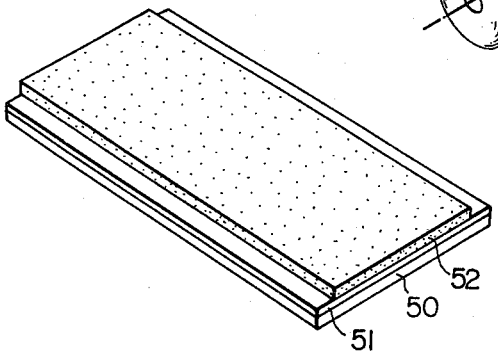
FIG. 4 is a view of the material shown in FIG. 3 cut to size.

The steps of manufacturing a photosensitive member such as photosensitive belt will be generally described. FIG. 3 shows a roll of photosensitive member, which is cut to a length corresponding to the peripheral length of the belt. FIG. 4 schematically shows the photosensitive membe cut to length. It comprises an insulating support 50 such as a polyester film on which a conductive layer 51 is formed as by evaporation of aluminium. In addition, a photosensitive layer 52 is formed on top of the conductive layer. Where the photosensitive member is in the form of an OPC photosensitive member, the photosensitive layer 52 may comprise a lower charge generating layer (CGL) and an upper charge transfer layer (CTL). Alternatively, the photosensitive layer may comprise a single OPC photosensitive material. In FIG. 4, at both longitudinal ends of the photosensitive member, the conductive layer 51 is externally exposed in the form of a strip.

Figure 5:
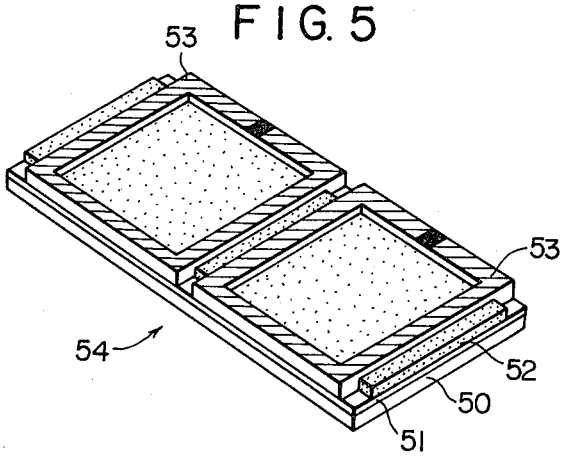
FIG. 5 is a perspective view of the photosensitive member in its finished form.

As shown in FIG. 5, a conductive paint or ink may be applied to the photosensitive member thus formed, as by screen printing technique, thus forming a layer 53 of a conductive material. The layer 53 of conductive material is applied to an area of the photosensitive layer 52 other than the surface region corresponding to the effective image area to be copied and which at least covers those portions of the photosensitive layer which effectively function as the photosensitive member during a copying process.

Figure 9:
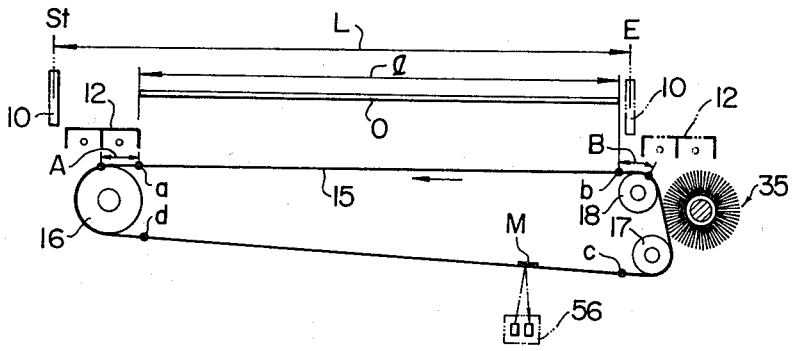
FIG. 9 is an illustration of a photosensitive belt for providing an explanation of a portion of the photosensitive layer which undesirably and effectively functions as a photosensitive member.

More specifically considering "those portions of the photosensitive layer which effectively function as a photosensitive member", it will be noted in FIG. 9, that the combination of the array 10 and the charger 12 integrally begins its forward stroke starting from the position St, and reaches the end position E after it has moved through the stroke L. In the meantime, the region of the belt 15 located between the points a, b is charged by the charger 12.

However, both regions A and b happen to be charged. This is because it is too late to turn on the charger 12 at the time when the point a reaches there and because it is very difficult to turn on the charger with a very accurate timing in a given stroke which terminates at the position E. Thus, the exposure and the charger may be turned off only after the charger 12 and the array 10 have overrun the point b, resulting in a charging the region B.

Since the regions A and B are unintendedly charged, the cleaning unit 35 obviously operates upon them. While such undesired charge may be removed by utilizing a quenching lamp, for example, a separate provision therefor is undesirable. While the developing unit 21 may be moved toward or away from the photosensitive belt 15 in timed relationship to avoid the toner from being deposited upon these regions, a complex mechanism results, presenting a difficulty in the sequence control.

Figure 6:
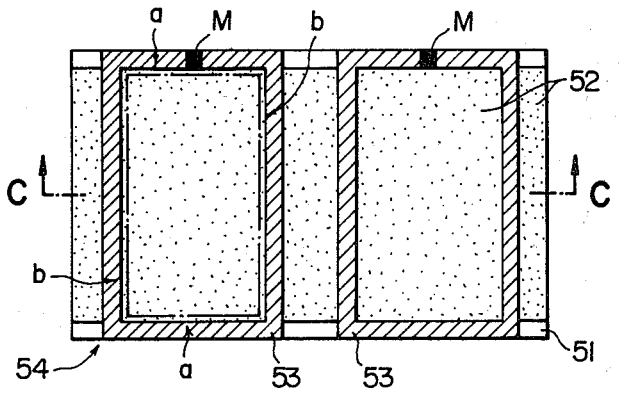
FIG. 6 is a plan view of the photosensitive member.

To recapitulate, such regions do not correspond to the effective image area to be copied and has no inherent contribution to the formation of a desired image, but effectively function as a photosensitive member. The term "effective image area" refers to a maximum copy size, for example, which corresponds to an area enclosed by phantom line lying within a framing defined by the layer 53 of conductive material as shown in FIG. 6. The area enclosed by the phantom line is slightly smaller than the framing defined by the layer 53 to provide a certain margin, but may coincide with the latter. It is to be noted that the width of such area corresponds to the width l of an original O shown in FIG. 9.

In the photosensitive member of the invention, the layer 53 of conductive material is applied to an area of the photosensitive layer other than a surface region corresponding to an effective image area and which effectively functions as a photosensitive member during a copying process.

Figure 7:
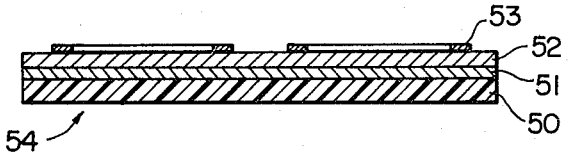
FIG. 7 is a cross section taken along the line C—C shown in FIG. 6.

The photosensitive member according to the invention is fabricated in a manner as illustrated in FIG. 5. FIG. 7 shows a cross section of the photosensitive member 54, which comprises an insulating support 50 formed by a polyester film or the like having a thickness on the order of 75 microns, a conductive layer 51 formed by the evaporation of aluminium and having a thickness from 400 to 700 Å, a photosensitive layer 52 having a thickness on the order of 22 microns, and a layer 53 of conductive material having a thickness on the order of 20 microns and a resistivity from $10^{-2}$ to $10^{10}$ ohm-cm. As shown in FIG. 6, the photosensitive layer includes two segments.

Figure 8:
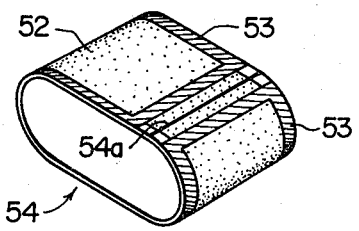
FIG. 8 is a perspective view of an endless belt formed with the photosensitive member shown in FIGS. 6 and 7.

The single photosensitive member 54 shown in FIG. 6 is formed into an endless belt as shown in FIG. 8, by bonding its opposite ends at a junction **54*a* as by ultrasonic or laser welding technique. One of the segments of the photosensitive layer corresponds to the region of the belt 15 located between the points a, b in FIG. 1** while other segment corresponds to the region between the points d, c. As mentioned previously, an electrostatic latent image is successively formed on each of these regions.

Referring to FIG. 6, it will be noted that a long the longitudinal edges of the photosensitive member, the conductive layer 51 is exposed in a strip form, which bears against the layer 53 of conductive material. Hence, one of these layers may be electrically connected to the ground. By way of example, when the electrical connection to the ground is made to the layer 53 of conductive material, a pair of brushes 55 may be disposed as shown in FIG. 2 so as to contact both lateral edges of the belt. Alternatively, rather than forming the strip-shaped, exposed conductive layer, the photosensitive layer 52 may be blanket covered except the segments, with the photosensitive layer locally removed in a region adjacent the opposite ends of the layer 53 to allow a locaized contact between the layers 51 and 53.

Referring to FIG. 6, a mark M is formed on the layer 53 (FIG. 6) and may be detected by a sensor 56 of reflection type, as indicated in FIG. 9. The mark M may be directly formed on the layer 53 or the layer 53 may be partly removed in the region of the mark M to permit the conductive layer 51 to be exposed directly. The only requirement is that the mark M be formed to permit its discrimination. Hence, the mark may be formed by an aperture so as to be detected by a sensor of transmission type.

In FIG. 6, a region a of the layer 53 is utilized to provide an electrical connection with the ground. Hence, a brush formed of metal fibers or carbon fibers of a conductive rubber roller may be disposed to engage this area, thus allowing the electrical connection with the ground to be maintained for the photosensitive belt which continuously rotates. This approach is advantageous in that it is inexpensive and compact in construction. No better alternative is currently available.

While the use of the brush is considered to be most preferred at the present time to provide the electrical connection with the ground, it is unavoidable that the abrasion of the conductive layer causes the problem of abrasion. With the conventional photosensitive member construction including a conductive layer and a photosensitive layer, the conductive layer is partly exposed for contact with the brush. However, because the conductive layer has a reduced thickness on the order of 400 to 700 Å, it becomes abraded with time, resulting in a failure to provide an electrical connection with the ground. Alternatively, a gap may be formed between the conductive layer and the brush as the layer becomes abraded, causing a flow of leak current during the charging step which induces a breakdown of the conductive layer. Where the conductive layer is formed of aluminium, a moisture or water vapor may converts it into aluminium hydroxide, causing a reduced conductivity. With a photosensitive member having three layers including an insulating support, a conductive layer and a photosensitive layer, the abrasion of the conductive layer which is utilized to provide an electrical connection with the ground may result in exposing the underlying insulating layer which may be charged during the charging step. With the photosensitive member of the invention, a layer of conductive material having a thickness on the order of 20 microns is formed on top of the basic conductive layer having a thickness on the order of 600 A, so that described problems and difficulties can be inclusively overcome. In addition, the layer of conductive material protects the base conductive layer formed of aluminium. It will be appreciated that the increased thickness of the layer of conductive material provided in accordance with the invention has a great significance which will be understood if one considers that the photosensitive belt is subject, not only to a brushing action to provide an electrical connection with the ground, but also to the action of a developing sleeve or a cleaning brush. Furthermore, the layer of conductive material increases the rigidity of the photosensitive member to reduce the pressure of contact against the flange 42 (FIG. 2), reducing the abrasion of lateral edges of the belt and preventing a deformation thereof.

In FIG. 6, a region b, located within the extent of the layer 53, represents an area of the photosensitive layer which effectively functions as a photosensitive member, as mentioned previously. However, the application of the conductive material to such region prevents it from being charged, and hence prevents the toner from depositing thereon. Consequently, no cleaning of such region is required. An area of the photosensitive layer which effectively functions as a photosensitive member may extend into a region a as shown in FIG. 6, depending on the margins of the copy size, the width of charging area and the width of exposed areas. If such region is charged with a usual photosensitive member, it will be uniformly subject to a toner deposition to form a solid black portion since it is not subject to an exposure. However, such result is avoided with the photosensitive member of the invention. Conversely, the toner consumption is reduced as is its dispersion, thus reducing the loading on the developing unit and the cleaning unit. It is to particularly noted that no particular means such as a quenching lamp is required to remove charges around the surface region corresponding to the effective image area. In addition, no mechanism is required to move the developing unit toward or away from the photosensitive member with a controlled timing.

Although a number of proposals have been made concerning photosensitive members of the type here concerned including Japanese Laid-Open Patent Application Nos. 64,936/1973, 155,237/1975, 24,232/1976, 72,435/1976, 146,830/1976 and 33,731/1977, Japanese Laid-Open Utility Model Application No. 53,339/1978 and Japanese Laid-Open Patent Application No. 125,850/1978. However, these relate to the electrical connection with the ground of the base conductive layer, which is distinct from the provision of the layer of conductive material in an area of the photosensitive layer which effectively functions as a photosensitive member, in accordance with the invention. In particular, Japanese Laid-Open Utility Model Application No. 53,339/1978 discloses the provision of a conductive, roughened area along one edge of a photosensitive member to permit a separation of a transfer sheet, which is again distinct from the functioning of the photosensitive member of the invention.

Figure 10A:
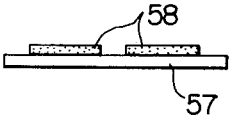
FIGS. 10(*a*) to 10(*c*) show conventional photosensitive members illustrating inconveniences experienced during their fabrication.
Figure 10B:
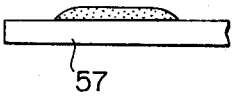
Figure 10C:
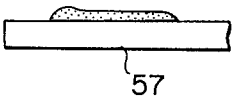
Figure 11:
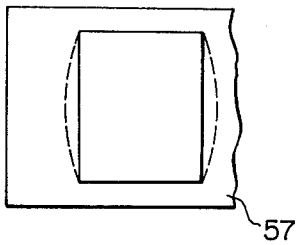
FIG. 11 is a plan view of the photosensitive member.

FIG. 10(*a*) discloses the formation of a photosensitive layer 58 by the application of a solution containing a photoconductive material to a conductive support 57. With this technique, the edge portions of the photosensitive layer will be deformed, as shown in FIGS. 10(*b*) and 10(*c*), preventing a uniform charge distribution from being formed on the photosensitive layer. In addition, an end or edge of the photosensitive layer may expand outwardly, as indicated in FIG. 11. In the photosensitive member of the invention, the conductive material is applied the photosensitive layer with a framing, so that deformation of the edge of the individual segments of the photosensitive layer is avoided. Finally, it should be understood that the photosensitive member of the invention may be constructed as a two-layer structure including a photosensitive layer formed on a conductive support.

What is claimed is:

1. A photosensitive member for use in an electrophotographic copying process comprising a conductive layer, a photosensitive layer formed thereon, and a layer of conductive material which is applied to an area of the photosensitive layer other than a surface region which corresponds to an effective image area to be copied.

2. A photosensitive member according to claim 1 in which said photosensitive member undergoes movement in a moving direction, and the layer of conductive material is applied to both lateral edges of the photosensitive layer with respect to said moving direction.

3. A photosensitive member according to claim 1 in which said photosensitive member undergoes movement in a moving direction so that said photosensitive layer has leading and trailing edges, and the layer of conductive material is applied to the leading and the trailing edge of the photosensitive layer.

4. A photosensitive member according to claim 1 in which a portion of the photosensitive member is partly removed in a region located below the layer of conductive material to permit the base conductive layer to be exposed for contact with layer of conductive material, one of the conductive layer and the layer of conductive material being electrically connected with the ground.

5. A photosensitive member according to claim 1 in which the photosensitive layer comprises a two-layer OPC photosensitive layer including a lower charge generation layer and an upper charge transfer layer.

6. A photosensitive member according to claim 5 in which the conductive material comprises an ink-like conductive paint.

7. A photosensitive member according to claim 1 in which the photosensitive layer comprises a single layer of OPC photosensitive material.

8. A photosensitive member according to claim 1 in which the layer of conductive material is formed by the application of a conductive material to the photosensitive layer.

9. A photosensitive member according to any of claims 1 to 5, 7 or 8 formed by a sheet of a photosensitive member having its ends joined together to form an endless belt.

10. A photosensitive member according to claim 8 in which a surface region of the photosensitive layer corresponding to an effective image area is circumferentially framed by the layer of conductive material to define a plurality of segments of the photosensitive layer in the endless belt.

11. A photosensitive member according to claim 8 in which a lateral edges of the endless belt is formed by a mark which is detected to control a belt drive.

* * * * *